US010132079B2

(12) United States Patent
Zollig

(10) Patent No.: US 10,132,079 B2
(45) Date of Patent: Nov. 20, 2018

(54) STOREY CEILING CONSTRUCTION AND BUILDING MADE OF WOOD

(71) Applicant: Timber Structures 3.0 AG, Thun (CH)

(72) Inventor: Stefan Zollig, Thun (CH)

(73) Assignee: Timber Structures 3.0 AG (CH)

( * ) Notice: Subject to any disclaimer, the term of this patent is extended or adjusted under 35 U.S.C. 154(b) by 0 days.

(21) Appl. No.: 14/786,820

(22) PCT Filed: Mar. 31, 2014

(86) PCT No.: PCT/EP2014/056408
§ 371 (c)(1),
(2) Date: Feb. 5, 2016

(87) PCT Pub. No.: WO2014/173634
PCT Pub. Date: Oct. 30, 2014

(65) Prior Publication Data

US 2016/0258155 A1 Sep. 8, 2016

(30) Foreign Application Priority Data

Apr. 24, 2013 (CH) ..... 829/13

(51) Int. Cl.
*E04B 5/12* (2006.01)
*E04B 1/26* (2006.01)
(Continued)

(52) U.S. Cl.
CPC ..... *E04B 5/12* (2013.01); *E04B 1/26* (2013.01); *E04B 9/06* (2013.01); *E04B 9/12* (2013.01);
(Continued)

(58) Field of Classification Search
CPC ..... E04B 5/12; E04B 5/14; E04B 1/10; E04B 1/02; E04B 1/26; E04C 2/386; E04C 3/122
See application file for complete search history.

(56) References Cited

U.S. PATENT DOCUMENTS 915,421 A * 3/1909 Eisen ..... 52/236.9
1,989,798 A * 2/1935 Foster ..... E04C 2/386 52/242
(Continued)

FOREIGN PATENT DOCUMENTS

DE 2108524 A1 5/1973
EP 1321598 A2 6/2003
EP 1381740 A1 1/2004
(Continued)

OTHER PUBLICATIONS

International Search Report for PCT/EP2014/056408 dated May 19, 2014, 4 pages.
(Continued)

*Primary Examiner* — Adriana Figueroa
*Assistant Examiner* — Jessie T Fonseca
(74) *Attorney, Agent, or Firm* — Blank Rome LLP

(57) ABSTRACT

Storey ceiling construction having a first lower wooden support (5) for supporting a storey ceiling, a first upper wooden support (5) for supporting a further storey ceiling and a first support head (6) made of wood for introducing the forces of the storey ceiling into the first lower wooden support (5). The first support head (6) lies on the first lower wooden support (5). The first upper wooden support (5) is supported directly on the first lower wooden support.

15 Claims, 4 Drawing Sheets

(51) Int. Cl.

| | |
|---|---|
| ***E04C 3/36*** | (2006.01) |
| ***E04B 9/06*** | (2006.01) |
| ***E04B 9/12*** | (2006.01) |
| ***E04F 15/04*** | (2006.01) |
| *E04B 5/14* | (2006.01) |
| *E04B 5/43* | (2006.01) |
| *E04B 5/02* | (2006.01) |

(52) U.S. Cl.
CPC ..... *E04C 3/36* (2013.01); *E04F 15/04* (2013.01); *E04B 5/02* (2013.01); *E04B 5/14* (2013.01); *E04B 5/43* (2013.01)

(56) References Cited

U.S. PATENT DOCUMENTS

| | | | | |
|---|---|---|---|---|
| 5,577,356 | A * | 11/1996 | Hubbard | E04B 2/702 52/233 |
| 6,032,434 | A * | 3/2000 | Graf | E04B 1/26 52/309.11 |
| 6,534,143 | B1 | 3/2003 | Thoma | |
| 7,338,701 | B2 * | 3/2008 | Yokoo | B27D 1/04 156/306.6 |
| 2004/0101649 | A1 | 5/2004 | Thoma | |

FOREIGN PATENT DOCUMENTS

| | | | |
|---|---|---|---|
| JP | 2005059529 | A * | 3/2005 |
| WO | WO 00/03850 | A1 | 1/2000 |

OTHER PUBLICATIONS

European Search Report for EP18164930, dated Jul. 13, 2018, 8 pages.

* cited by examiner

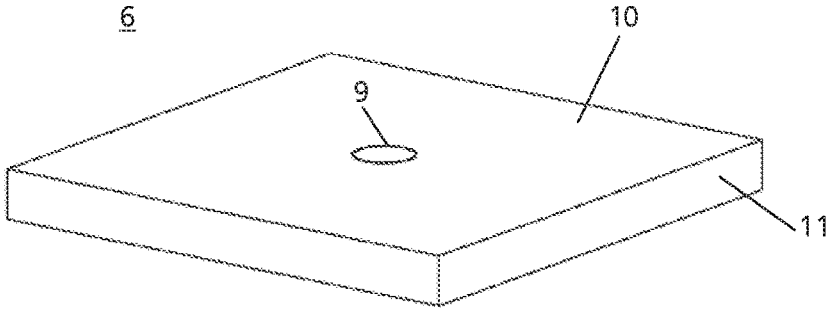
Fig. 3:
Fig. 4A:
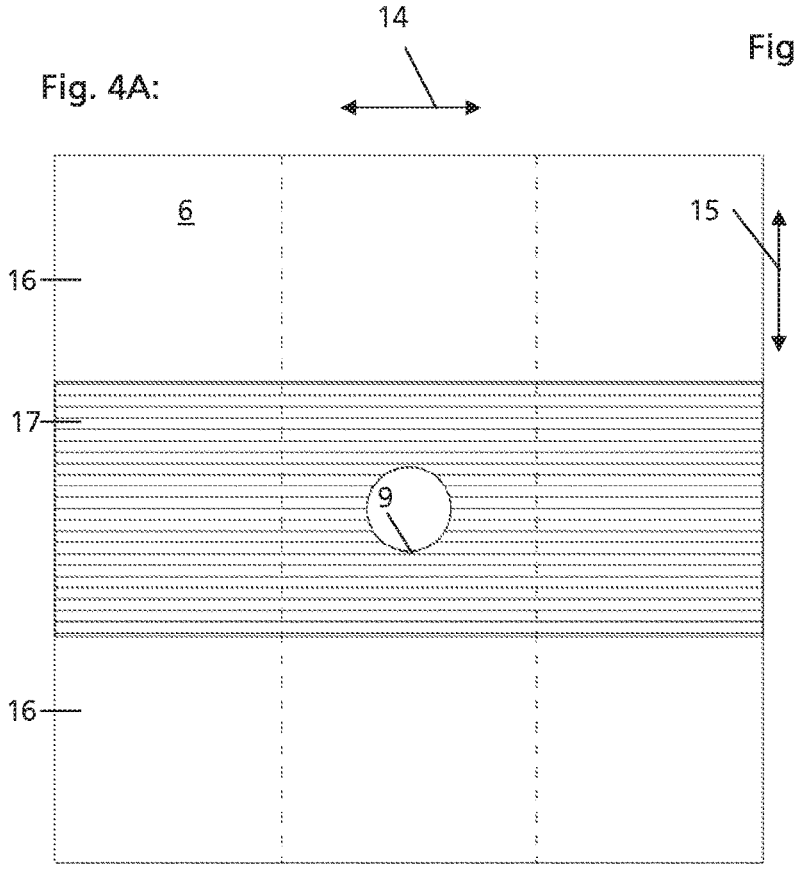
Fig. 4B:
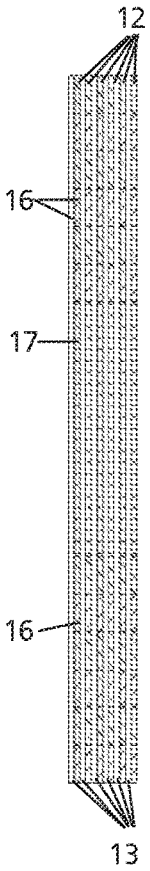
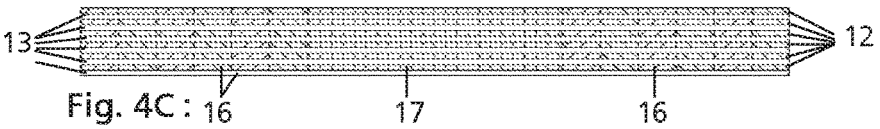
Fig. 4C :

STOREY CEILING CONSTRUCTION AND BUILDING MADE OF WOOD

RELATED APPLICATIONS

This application is a national phase of PCT/EP2014/056408 filed on Mar. 31, 2014, which claims priority to Switzerland Patent Application No. CH00829/13 filed on Apr. 24, 2013 . The contents of those applications are hereby incorporated by reference.

TECHNICAL FIELD

The invention relates to storey ceiling construction of wood and to a building made of wood.

STATE OF THE ART

It is known how to make buildings of wood. In this respect, inter-storey floor/ceiling slabs are generally placed on storey ceiling constructions. The supports that bear the storey are usually connected with a construction of cross members and/or longitudinal members, and on these cross and/or longitudinal members the storey ceiling is placed. Such constructions, however, have a series of disadvantages.

If rooms without any supports are desired, the cross members and/or longitudinal members of timber must be adjusted in terms of their thickness to the load to be borne. For distances between supports of 8 times 8 meters, this would mean a thickness of the longitudinal and/or cross members of approx. 1 m. Due to the reduction of the ceiling height caused by this thickness, such distances between supports are therefore not possible nowadays in timber construction with the timber constructions of the state of the art.

The construction of multi-storey buildings in timber construction is also limited by the characteristics of wood. The longitudinal members and/or cross members lie on a lower support, whilst the upper support in turn lies on the longitudinal and/or cross member. The fiber direction of the longitudinal and/or cross members however lies in the plane of the storey ceiling, i.e. at a right angle to the supports. Wood, however, has the property of being very stable vis-à-vis forces acting in the longitudinal direction of the wood fiber, but very weak at a right angle to the fiber. If a support rests on a cross member and/or longitudinal beam, the entire force of the upper support is first transmitted onto the cross member and/or longitudinal beam and only then from there onto the lower support. The load to be borne by the upper support is thus limited by the transverse stability of the longitudinal and/or cross members. Multi-storey buildings multiply the weight force of a support on the cross member and/or longitudinal beam. It is therefore not possible nowadays to have too high a number of storeys in timber construction.

There are therefore in the state of the art no multi-storey buildings with great distances between the supports, wherein the supports are also constructed of wood.

In patent document U.S. Pat. No. 915,421 , a steel or reinforced concrete construction is proposed for timber buildings. The support construction has a modular construction of supports and support/prop heads of steel or reinforced concrete in order to support the storey ceilings of timber buildings. The loads of multi-storey buildings of wood can thus be supported. However, this has the disadvantage that the support construction cannot be made of wood.

DE2108524 discloses a support construction of steel, reinforced concrete or plastic.

REPRESENTATION OF THE INVENTION

It is an aim of the invention to find a storey ceiling construction of wood that allows a great distance between the supports as well as multi-storey buildings and that does not require any steel or reinforced concrete elements.

According to the invention, this aim is achieved with a storey ceiling construction according to claim 1. The storey ceiling construction has a first lower wooden support for supporting the storey ceiling, a first upper wooden support for supporting a further storey ceiling and a first support head made of wood for introducing the forces of the storey ceiling into the first lower wooden support. The first support head lies on the first lower wooden support and the first upper wooden support is supported directly on the first lower wooden support.

According to the invention, this is achieved further by a building with such a storey ceiling construction.

This has the advantage that a support head of a storey ceiling can rest on a lower support, and simultaneously the force of the upper support can be introduced into the lower support, without the force being transmitted via the storey ceiling that is not designed for this.

The aim is further achieved through a wood component, preferably a panel. The wood component having at least a first timber layer with a first main fiber direction and at least a second timber layer, parallel to the first timber layer, with a second main fiber direction, wherein one of the two outermost timber layers of the lamination a first timber layer and the other of the two outmost timber layers of the lamination is a second timber layer. Examples for such wood components are the wood components of the storey ceiling.

Such a wood component has the advantage that it transmits the same force in both main fiber directions.

The aim is achieved furthermore alone by the support head described hereinafter.

Further advantageous embodiments are indicated in the dependent claims.

In one embodiment, the first support head has a recess, and the first upper wooden support and/or the first lower wooden support is/are lead through the recess of the first support head, so that the first upper wooden support can rest directly on the first lower wooden support. Thanks to the recess, it is achieved that the first support head can rest in the peripheral area of the recess on the support and despite the storey ceiling being closed, the upper support can rest directly on the lower support through the recess, without having the weight of the upper support affect the storey ceiling.

In one embodiment, the first upper wooden support and the first lower wooden support are introduced in the recess of the first support head, so that the first upper wooden support rests within the recess of the first support head directly on the first lower wooden support. This has the advantage that the upper and lower support stabilize themselves in the recess and an additional fastening of one of the supports becomes superfluous.

In one embodiment, the first lower wooden support, on the side facing the first support head, is executed in tapering fashion so that the first lower wooden support is introduced into the recess of the first support head, and the first support head rests with the edge of the recess on the shaped step of the first lower wooden support.

In one embodiment, the first lower wooden support and/or the first upper wooden support has a main fiber direction at a right angle to the storey ceiling resp. the upper surface side of the first support head. This has the advantage that the support is designed to be very stable in the direction of support.

In one embodiment, the first support head of wood has a first main fiber direction and a second main fiber direction, wherein the first main fiber direction and the second main fiber direction are arranged at a right angle to one another and in the plane of the storey ceiling. Through the arrangement at a right angle, forces can be transmitted optimally in the plane of the support head resp. of the storey ceiling.

In one embodiment, the first support head has a plurality of timber layers, wherein in the plurality of timber layers, a first timber layer with the first main fiber direction alternates with a second timber layer with the second main fiber direction. Thanks to the alternating arrangement of the layers with the first and the second main fiber direction, very stable panels are achieved in the plane, which can effectively transmit the forces in the plane in all directions. In this manner, the functions of the longitudinal and cross members are united within the storey ceiling itself.

In one embodiment, the first timber layer has at least two wood elements that lie next to one another in the layer plane in the direction of the second main fiber direction, and/or the second timber layer has at least two wood elements lying next to one another in the layer plane in the direction of the first main fiber direction, wherein the at least two wood elements of a timber layer have one wood element of one species of timber and one wood element of a second species of timber. Thanks to the represented lamination of different wood species, areas with the first timber species, areas with the second timber species and areas with the first and second timber species will occur.

In one embodiment, the first timber layer has three wood elements lying next to one another in the layer plane in the direction of the second main fiber direction and/or the second timber layer has three wood elements lying next to one another in the layer plane in the direction of the first main fiber direction, wherein the three wood elements of a timber layer alternatingly have one wood element of a first timber species and one wood element of a second timber species. This embodiment is particularly advantageous when a different wood species, mostly a more stable one, is to be used in the middle than in the peripheral areas.

In one embodiment, the support head has at least one first area with a plurality of timber layers of a first timber species, at least one second area with a plurality of timber layers with a second timber species and at least a third area with a plurality of timber layers in which the first wood species and the second wood species alternate.

In one embodiment, the recess is placed in the second area, and the second timber species is more stable than the first timber species. In this way, a more stable wood is used in the area of the recess, in which the forces of the storey ceiling are concentrated, than in the peripheral areas. It is thus possible to limit the use of expensive wood to the essential area around the recess.

In one embodiment, the inter-storey floor/ceiling construction has a storey ceiling having the first support head and an auxiliary supporting structure, wherein the auxiliary supporting structure has a plurality of timber layers, wherein in the plurality of timber layers a first timber layer with the first main fiber direction alternates with a second timber layer with the second main fiber direction.

In one embodiment, the layer thickness and/or the main fiber direction of the plurality of timber layer of the auxiliary supporting structure correspond(s) to the layer thickness and/or to the main fiber direction of the plurality of timber layers of the support head.

In one embodiment, the auxiliary supporting structure is connected on the front end/short side with a front end of the support head.

In one embodiment, the auxiliary supporting structure is arranged on the front end with a front end of the support head through a gap at a distance, and the auxiliary supporting structure is connected in bearing fashion with the support head via an adhesive layer filled into the gap.

In one embodiment, the uppermost layer of the support head has a main fiber direction that runs perpendicular to the main fiber direction of the lowest layer of the support head.

In one embodiment, the uppermost layer of the auxiliary supporting structure has a main fiber direction that runs perpendicular to the main fiber direction of the lowest layer of the auxiliary supporting structure.

In one embodiment, the storey ceiling construction has a second lower support, a third lower support, a fourth lower support, a second upper support resting on the second lower support, a third upper support resting on the third lower support, a fourth upper support resting on the fourth lower support, wherein the storey ceiling furthermore has a second support head resting on the second lower support, a third support head resting on the third lower support and a fourth support head resting on the fourth lower support, wherein the auxiliary supporting structure has four first auxiliary supporting elements connecting two neighboring support heads and at least a second auxiliary supporting element that connects the four first auxiliary supporting elements and forms a closed surface of the storey ceiling between the four first auxiliary supporting elements.

In one embodiment, the support head forms a rectangular block shape with two upper surface sides parallel to the first and second main fiber direction, with two front ends that are arranged parallel to the first main fiber direction, and with two front ends that are arranged parallel to the second main fiber direction.

In one embodiment, the storey ceiling construction has the further storey ceiling on the upper supports.

BRIEF DESCRIPTION OF THE FIGURES

The invention will be explained in more detail on the basis of the attached figures, which show:

FIG. 3 a three-dimensional view of a support head of the storey ceiling;

FIG. 4A a top view of a support head;

FIG. 4B a first side view of the support head;

FIG. 4C a second side view of the support head;

WAYS FOR EXECUTING THE INVENTION

Figure 1:
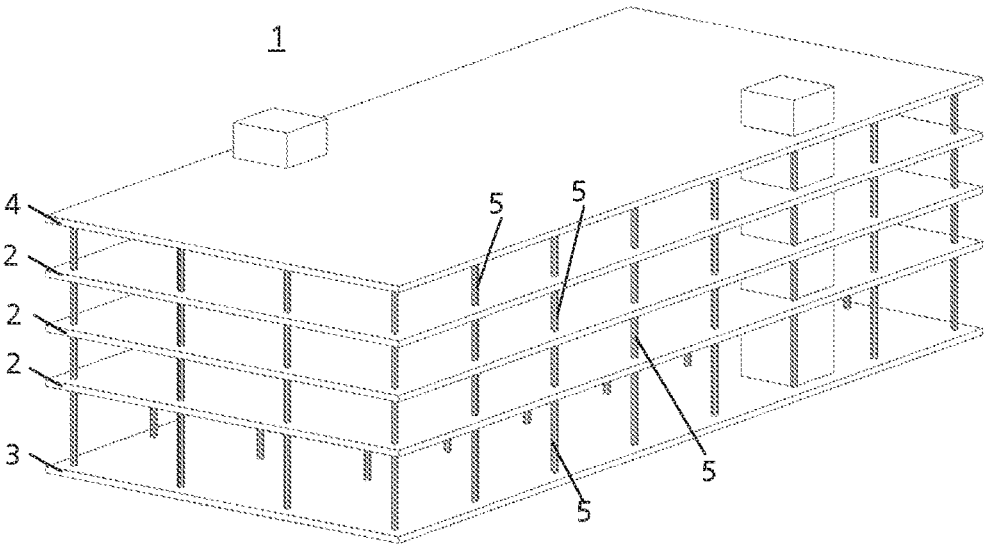
FIG. 1 a view of a building with the inventive storey ceiling construction.

FIG. 1 shows the example of a building 1 with an inventive storey ceiling construction. The building has a floor slab 3, three storey ceilings 2 and an upper storey ceiling 4. Each storey ceiling 2 and 4 in this respect rest on at least one support 5. Preferably, yet without limiting the invention, a storey ceiling 2 or 4 rests on at least four supports.

Figure 2:
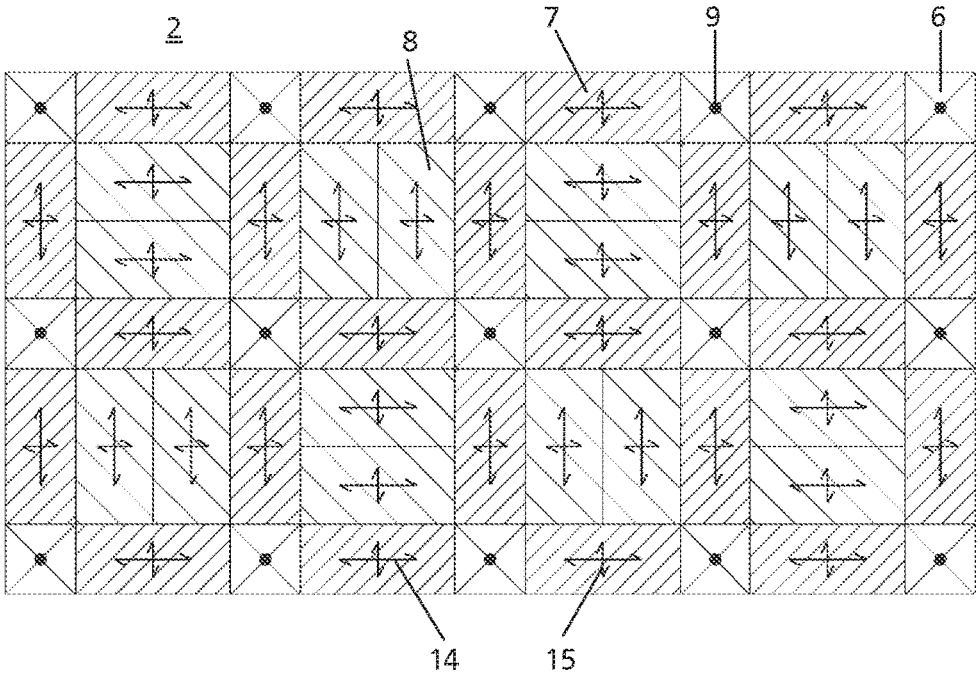
FIG. 2 a top view of a composition of a storey ceiling.

FIG. 2 shows an embodiment of a storey ceiling 2. The storey ceiling 2 consists of a plurality of support heads 6, of a plurality of first auxiliary supporting elements 7 and of a plurality of second auxiliary supporting elements 8. The first auxiliary supporting elements 7 and the second auxiliary supporting elements 8 form an auxiliary supporting structure of the storey ceiling 2.

Each support head 6 has a recess 9 that is designed for supporting an upper support 5 arranged between the storey ceiling 2 and a storey ceiling lying above it, directly onto a lower support 5 which supports the storey ceiling 2. To directly support in this context means that the force of the upper support 5 is introduced mainly into the lower support 5 and only a small or negligible portion of the force is introduced in the storey ceiling 2. This can occur by placing the upper support 5 on the support 5 lying beneath it or by placing the upper support 5 on a wood transmission element that has a main fiber direction parallel to the main fiber direction of the upper and lower support 5 and which itself lies on the lower support 5. In this way, the weight force of the upper storeys can be transported away directly through supports placed one above another down to the foundations, without any of the story ceilings 2 having to withstand the collected weight force of the superposed storeys. In this way, the load of a single support 5 is limited no longer to the resistance at a right angle to the fiber of the storey ceiling but only by the higher resistance of the supports in the longitudinal direction of the fiber.

FIG. 3 shows a three-dimensional view of the support head 6 isolated out of the storey ceiling 2. The support head 6 forms a panel with two surface sides 10 and four side faces 11. In most cases, the area of the surface sides 10 is greater than that of the side faces 11, however the invention is not limited to this. The panel in this respect preferably forms a rectangular block shape, i.e. the six sides 10 and 11 are perpendicular to their respective adjoining sides. However, the support head 6 can also form other panel shapes and the side faces, instead of being at a right angle, can also have a beveled, concave or convex shape.

The first auxiliary supporting elements 7 in FIG. 2 are preferably also formed in a rectangular block shape with two surface sides and four side faces. Each first auxiliary supporting element 7 connects two support heads 6. For this purpose, one side face of the first auxiliary supporting element 7 is connected with one side face 11 of one of the support heads 6. The side face 11 of a further support head 6 is connected at the opposite side face of the first auxiliary supporting element 7 also to the side face of the first auxiliary supporting element 7. Each support head 6 is connected at two, three or four side faces 11 with the side face of a first auxiliary supporting part 7, depending on whether the support head 6 is at a corner, at the edge or in the middle of the building resp. of the storey ceiling. Thus four support heads 6, that are each connected with four first auxiliary supporting elements 7, form a quadratic or rectangular panel, whose center has a quadratic or rectangular recess.

The second auxiliary supporting elements 8 are preferably also formed in a rectangular block shape with two surface sides and four side faces. The recess between the four first auxiliary supporting elements 7 is closed by at least one second auxiliary supporting element 8. In FIG. 2, two second auxiliary supporting elements 8 are used in order to close the recess. Each second auxiliary supporting element 8 in FIG. 2 connects with the four side faces thus to the side faces of three first auxiliary supporting elements 7 and of the neighboring further second auxiliary supporting element 8.

The support head 6 is made of wood. The wood is preferably plywood, for example cross-laminated timber or veneer plywood, with neighboring layers of differently oriented wood fibers. FIG. 4A, B, C shows an example of a wood structure of the support head 6. FIG. 4A shows a top view of the upper surface side 10 of the support head 6. FIGS. 4B and 4C each show a side face 11 of the support head 6. In FIGS. 4B and 4C, the layer structure of the support head 6 can be clearly seen. The support head 6 consists of alternating first layers 12 and second layers 13. The first layers 12 are made of wood with a first main fiber direction 14, the second layers 13 are made of wood with a second main fiber direction 15. Preferably, the first main fiber direction 14 and the second main fiber direction 15 have different directions. Preferably, the first main fiber direction 14 is arranged at a right angle to the second main fiber direction 15. The first and the second main fiber direction 14 and 15 are both arranged in the layer plane. The main fiber directions 14 and 15 cut the four side faces 11 and run parallel to the two surface sides 10. Preferably, each main fiber direction 14 and 15 is respectively parallel to two side faces 11 and at a right angle to the remaining two side faces 11. Thanks to this structure, the support head can transmit forces well both in the direction of the first main fiber direction 14 as in the direction of the second main fiber direction 15.

Since the whole forces have to be directed on the storey ceiling 2 to the support heads 6 and from there over the supports 5, the support heads 6, in particular the area of the support heads 6 around the recess 9, are subjected to the highest forces within the storey ceiling 2. The support 6 is therefore preferably executed in solid timber. In the embodiments in FIGS. 4A, 4B, 4C, the support head 6 is made of two types of timber. Each layer consists of three wood elements placed next to one another that extend in the corresponding main fiber direction 14 or 15 of the layer over the entire length of the support head 6 and are next to one another at a right angle to the corresponding main fiber direction 14 or 15 of the layer. In this respect, the outer two wood elements of a layer are made of a first timber species 16, and the wood element of the same layer arranged in the middle between the outer two wood elements is made of a second timber species 17. In FIG. 4A, the upper layer of the support head 6, which is a first layer 12, can be seen. As described, the two outer wood elements are made of the first timber species 16 and the middle wood element of the second timber species 17. The three wood element of the uppermost layer respectively extend in the direction of the first main fiber direction 14 over the entire length of the support head 6 and are arranged in the direction of the second main fiber direction 15 next to one another. FIG. 4A simultaneously shows in dotted line the wood elements of the second layer 13 that is directly under the uppermost layer. Here too, the two outer wood elements consist of the first timber species 16 and the middle wood element of the second timber species 17. The three wood elements of the second layer 13 that is under the uppermost layer and of all other second layers 13 extend respectively in the direction of the second main fiber direction 15 over the entire length of the support head 6 and thus at a right angle to the wood elements of the uppermost layer and of all other first layers 12. The three wood elements of the second layer 13 that is under the uppermost layer and of all other second layers 13 are arranged in the direction of the first main fiber direction 14 next to one another. Thus, nine different areas are formed by means of the described layering. Due to the arrangement in the middle of the middle wood element of each and every layer, a middle area of the support head 6 is formed in which all middle wood elements cross each other, and that is thus exclusively made of the second timber species 17. Due to the arrangement in the middle of the recess 9, the border of the recess 9 thus consists of the second timber species 17. IN the four corner areas, only wood elements consisting of the first timber species 16 are superimposed over one another, so that here four areas are formed that are made only of the first timber species 16. In the four remaining areas, the timber species 16 and 17 alternate from layer to layer. If then the second timber species 17 is chosen to be more stable than the first timber species 16, a greater stability will occur in the center of the support head 6 in the area of the recess 9 than in the border areas. Different timber types can not only include different species of tree but also different types of processing of the timber of the same species of tree. The first timber species 16 can for example consist of spruce plywood and the second timber species 17 of beech veneer plywood. Since beech is harder than spruce, the middle area is more stable.

Figure 5:
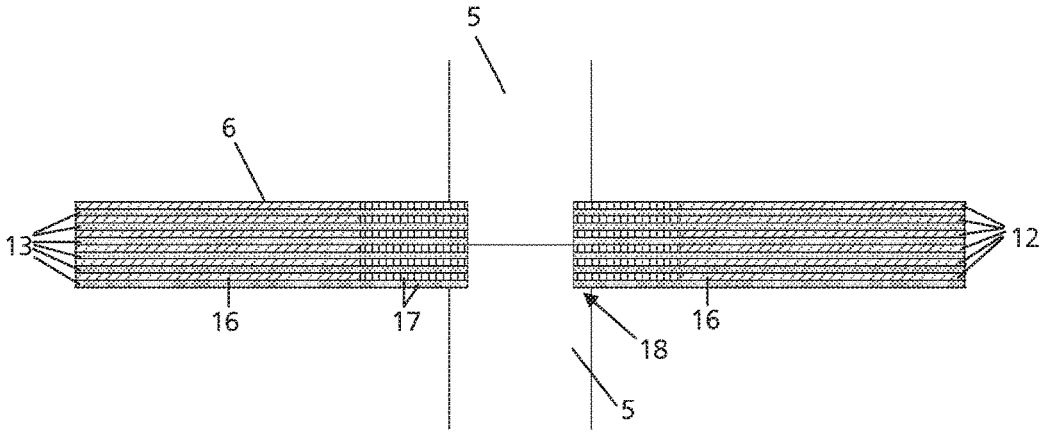
FIG. 5 a cross section through a storey ceiling construction.

FIG. 5 shows a cross section through a support head 6 and through an upper and lower support 5. The lower support 5 has a cross section that is greater than the recess 9 of the support head 6. On the upper extremity of the lower support 5, the cross section of the lower support 5 is reduced to the cross section of the recess or smaller. Thus, a step 18 is formed on which the support head 6 can rest. To support the storey ceiling 2, the reduced cross section of the lower support 5 is introduced in the recess 9 of the support head 6 until the support head 6 rests on the step 18. The upper support 5 has on the lower side also a reduced cross section that is also introduced in the recess 9 of the support head until the upper support 5 rests on the lower support. In this manner, the weight force can be transmitted from the storey ceiling 2 through the step 18 onto the lower support 5. Simultaneously, the weight force can be transmitted from the upper support 5 without additional load for the storey ceiling 2 onto the lower support 5.

Figure 6:
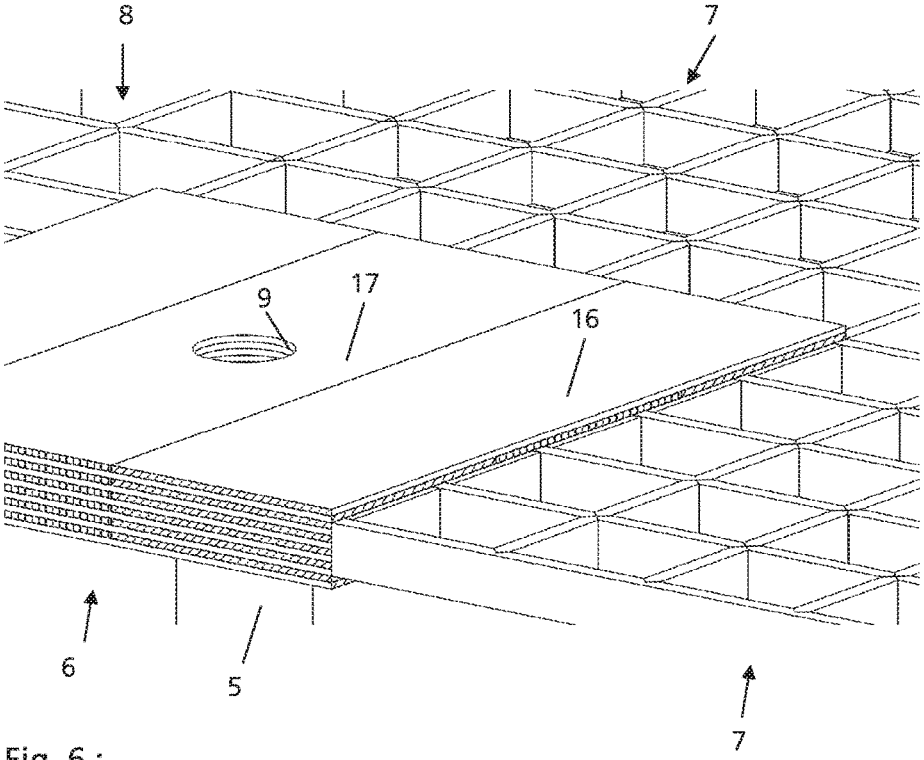
FIG. 6 a three-dimensional view of a part of the storey ceiling on a support with a first embodiment of the auxiliary supporting elements.

FIG. 6 shows an embodiment of a storey plane 2 with a lower support 5. In this embodiment, the first auxiliary supporting element 7 and the second auxiliary supporting element 8 has a hollow box structure of cross members placed at a right angle to one another and which is covered respectively above and below with at least one timber layer. The at least one timber layer at the top side and bottom side consists in this embodiment respectively of two layers, which have not been represented here for the sake of a better representation of the hollow box structure. The layers on and under the hollow box structure have alternatingly a first and a second layer with each a first main fiber direction 14 and a second main fiber direction 15. The layers on and under the hollow box structure of the first and second auxiliary supporting elements 7 and 8 are, by comparison with the support head 6, executed in such a way that the first layers on the side faces of the support head 6 and of the first or second auxiliary supporting element 7 or 8 to be connected and accordingly are also opposite the second layers. The storey ceiling 2 thus has the same main fiber direction in every layer on and under the hollow box structures of the first and second auxiliary supporting elements 7 and 8 and of the corresponding layer of the support head 6 over the entire surface of the storey ceiling 2.

Figure 7:
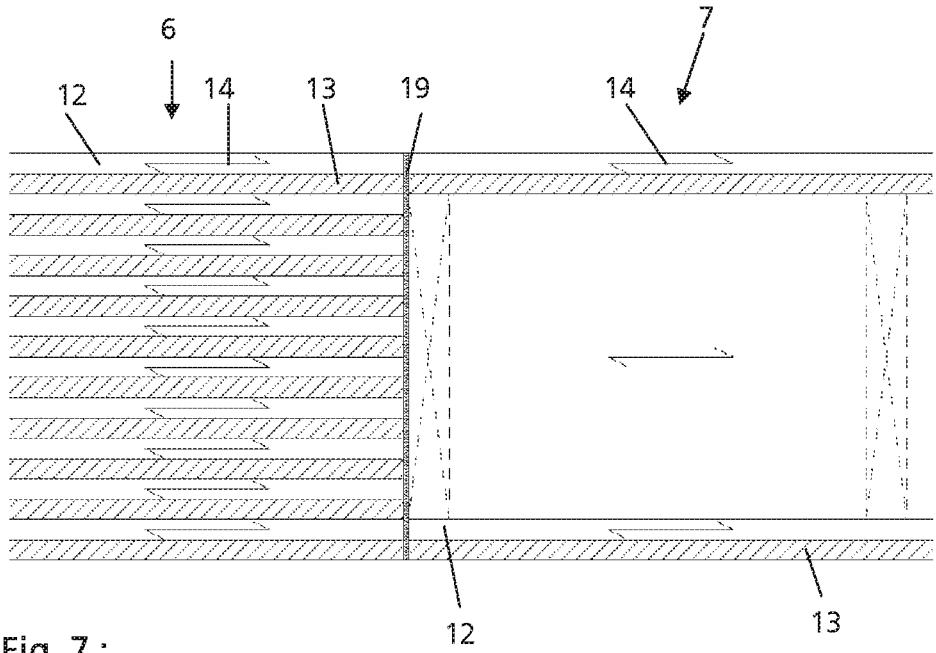
FIG. 7 a cross section through a connection of the support head with the first embodiment of an auxiliary supporting element.

FIG. 7 shows a cross section through the connection point between the support head 6 and the first auxiliary supporting element 7. The structural front-end connection between a front end 11 of the support head 6 and a front end of the first auxiliary supporting element 7 is achieved by means of an adhesive layer 19.

Figure 8:
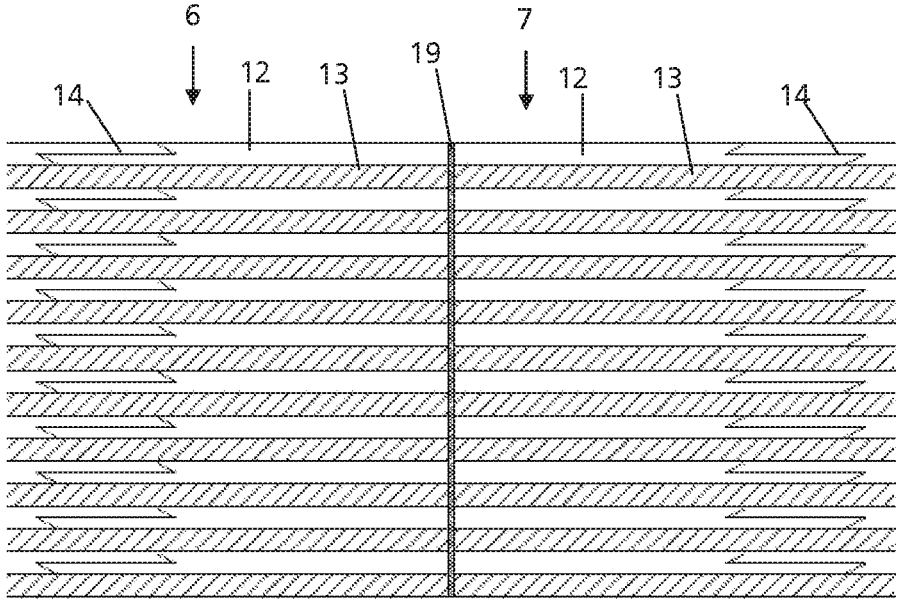
FIG. 8 a cross section through a connection of the support head with a second embodiment of an auxiliary supporting element.

FIG. 8 shows an alternative embodiment of the auxiliary supporting elements 7 and 8. The first and second auxiliary supporting elements 7 and 8 consist of massive wood that has alternatingly first layers 12 and second layers 13. The layers in the support head 6, in the first auxiliary supporting element 8 and the second supporting element 9 are arranged respectively in the same manner, so that the layers having the same main fiber direction are opposite the front ends of all parts to be connected. The storey ceiling 2 thus has in each layer the same main fiber direction. In this way, in each layer of the storey ceiling 2, the force is transmitted either in the main fiber direction 14 or the second main fiber direction 15. The structural front-end connection between a front end 11 of the support head 6 and a front end of the first auxiliary supporting element 7 is achieved by means of an adhesive layer 19.

To achieve a structural connection is done as follows. First, the front ends of the elements to be connected are arranged in such a manner that the layers of same main fiber direction are opposite and the parts to be connected form a gap between the front ends. In this position, the two elements to be connected are fixed. The gap between the elements to be connected is sealed at the edges, e.g. by filling in. Subsequently, the interstice of the gap 19 is filled with adhesive. When the adhesive has hardened, there is a structural connection. As adhesive, a two-component adhesive is preferably used, whose two components are mixed upon being filled into the gap 19. By mixing the two components, the adhesive starts to harden. The adhesive PURBOND CR 421 from the Swiss company Purbond for example was tested as adhesive. This two-component polyurethane cast resin has been approved by the German Institute of Structural Engineering under registration number Z-9.1-707 for the gluing of steel rods in structural timber components and is freely available. Using this adhesive, a connection between two wood elements was measured with traction resistances of up to 20 Newton per square millimeter (N/mm2). Thanks to this technique, the construction of large storey ceilings 2 through the front-end gluing of support heads 6, auxiliary supporting elements 7 and 8 is possible that uniformly distribute the force over the entire plane of the storey ceiling 2 and transmit it to the supports 5. Alternatively, instead of gluing, the connection can be achieved with alternative connection means such as steel connecting means.

Preferably, all parts of the storey ceiling 2, i.e. the support heads 6, the first auxiliary supporting elements 7 and the second supporting elements 8 are constructed in such a way that the upper layer has a main fiber direction that is at a right angle to the main fiber direction of the lower layer. In the state of the art, the upper and the lower layer are always made with the same main fiber direction, otherwise the panels would warp. This however has the disadvantage that the panels in the main fiber direction of the upper and lower layer are more stable than in the other of the two main fiber directions of the panel. This is why the disadvantage of warping of the panels is deliberately taken into account in order to make panels that are similarly stable in both main fiber directions.

Thanks to the inventive inter-storey floor/ceiling slab construction for a storey ceiling 2, the force from the storey ceiling 2 can now be introduced in the plane of the storey ceiling 2 itself and not over separate structures in a support 5, and simultaneously the forces of the upper storeys are introduced from the upper support 5 directly onto the lower support 5. By using the storey ceiling 2 itself as force-transmitting element, additional supports for the storey ceiling 2 can be omitted and the storey ceiling 2 can be made thinner than a corresponding support. Thanks to this construction, storey ceilings 2 with distances between supports of eight times eight meters are achieved. The storey ceiling 2 in this case preferably forms a panel of the same thickness over the entire plane of the storey ceiling, which itself operates as structural element for the storey ceiling 2 and doesn't require additional supports.

When in this application the terms lower/below or upper/above are used, they relate to lower/below in the direction of gravity and upper/above in the direction opposite to gravity.

In the described embodiment, the first and second main grin directions 14 and 15 of the neighboring layers of the elements of the storey ceiling were at a right angle to one another. Another angle between the main fiber directions and a greater number of main fiber directions could also occur. The three different layers could thus have main fiber directions that are at a 60° angle to one another, so that force transmissions operate in the storey plane along three directions. The forces could thus possibly be directed better to the support head. However, such constructions are more complicated.

The invention is not limited to the described embodiment. Each embodiment contained in the wording of the independent claims is included in the invention.

The invention claimed is:

1. Storey ceiling construction having a first lower wooden support for supporting a storey ceiling, a first upper wooden support for supporting a further storey ceiling and a first support head made of wood for introducing the forces of the storey ceiling into the first lower wooden support, wherein the first support head lies on the first lower wooden support and the first upper wooden support is supported directly on the first lower wooden support, wherein the first lower wooden support and the first upper wooden support has a main fiber direction at a right angle to the storey ceiling, wherein the first support head has a first main fiber direction and a second main fiber direction different from the first main fiber direction, wherein the first main fiber direction and the second main fiber direction are arranged in the plane of the storey ceiling, wherein the first support head has a plurality of timber layers parallel to the plane of the storey ceiling, wherein in the plurality of timber layers, a first timber layer comprising fibers extending at least in the first main fiber direction over the complete first support head alternates with a second timber layer comprising fibers extending at least in the second main fiber direction over the complete first support head, wherein the first timber layer comprises exclusively the first main fiber direction or does not comprise a main fiber direction being perpendicular to the plane of the storey ceiling, wherein the second timber layer comprises exclusively the second main fiber direction or does not comprise a main fiber direction being perpendicular to the plane of the storey ceiling.

2. Storey ceiling construction according to claim 1, wherein the first support head has a recess, and the first upper wooden support and/or the first lower wooden support is/are lead through the recess of the support head, so that the first upper wooden support can rest directly on the first lower wooden support.

3. Storey ceiling construction according to claim 1, wherein the first lower wooden support, on the side facing the first support head, is shaped with a step so that the first lower wooden support above the step is introduced into a recess of the first support head, and the first support head rests with an edge of the recess on the step of the first lower wooden support.

4. Storey ceiling construction according to claim 1, wherein the first main fiber direction and the second main fiber direction are arranged perpendicular to one another.

5. Storey ceiling construction according to claim 1 comprising the storey ceiling, wherein the storey ceiling comprises the first support head and an auxiliary supporting structure, wherein the auxiliary supporting structure has a plurality of timber layers, wherein in the plurality of timber layers a first timber layer with the first main fiber direction alternates with a second timber layer with the second main fiber direction.

6. Storey ceiling construction according to claim 5, wherein the auxiliary supporting structure is connected on a side face with a side face of the first support head.

7. Storey ceiling construction according to claim 6, wherein the auxiliary supporting structure is arranged on the side face with a gap at a distance to the side face of the first support head , and the auxiliary supporting structure is connected in bearing fashion with the first support head via an adhesive layer filled into the gap.

8. Storey ceiling construction according to claim 5, wherein the topmost timber layer of the support head and/or of the auxiliary supporting structure has a main fiber direction that runs perpendicular to the main fiber direction of the lowest timber layer of the first support head and/or of the auxiliary supporting structure.

9. Storey ceiling construction according to claim 5, having a second lower wooden support, a third lower wooden support, a fourth lower wooden support, a second upper wooden support resting on the second lower wooden support, a third upper wooden support resting on the third lower wooden support, a fourth upper wooden support resting on the fourth lower wooden support, wherein the storey ceiling furthermore has a second support head resting on the second lower wooden support, a third support head resting on the third lower wooden support and a fourth support head resting on the fourth lower wooden support, wherein the auxiliary supporting structure has four first auxiliary supporting elements connecting two neighboring of the support heads and at least a second auxiliary supporting element that connects the four first auxiliary supporting elements and forms a closed surface of the storey ceiling between the four first auxiliary supporting elements.

10. Storey ceiling construction according to claim 1, wherein the first support head has a rectangular block shape with six sides which are perpendicular to their respective adjoining sides.

11. Storey ceiling construction according to claim 1, wherein the first support head is made of cross-laminated timber.

12. Storey ceiling construction having a first lower wooden support for supporting a storey ceiling, a first upper wooden support for supporting a further storey ceiling and a first support head made of wood for introducing the forces of the storey ceiling into the first lower wooden support, wherein the first support head lies on the first lower wooden support and the first upper wooden support is supported directly on the first lower wooden support, wherein the first lower wooden support and the first upper wooden support has a main fiber direction at a right angle to the storey ceiling, wherein the first support head of wood has a first main fiber direction and a second main fiber direction different from the first main fiber direction, wherein the first main fiber direction and the second main fiber direction are arranged in the plane of the storey ceiling, wherein the first support head has a plurality of timber layers, wherein in the plurality of timber layers, a first timber layer with the first main fiber direction alternates with a second timber layer with the second main fiber direction, wherein the first timber layer has at least two wood elements that lie next to one another in a layer plane of the first timber layer in the direction of the second main fiber direction, and/or the second timber layer has at least two wood elements lying next to one another in a layer plane of the second timber layer in the direction of the first main fiber direction, wherein the at least two wood elements of a timber layer of the timber layers have one wood element of one species of timber and one wood element of a second species of timber, wherein the second timber species is more stable than the first timber species.

13. Storey ceiling construction having a first lower wooden support for supporting a storey ceiling, a first upper wooden support for supporting a further storey ceiling and a first support head made of wood for introducing the forces of the storey ceiling into the first lower wooden support, wherein the first support head lies on the first lower wooden support and the first upper wooden support is supported directly on the first lower wooden support, wherein the first lower wooden support and the first upper wooden support has a main fiber direction perpendicular to the storey ceiling, wherein the first support head of wood has a first main fiber direction and a second main fiber direction different from the first main fiber direction, wherein the first main fiber direction and the second main fiber direction are arranged in the plane of the storey ceiling, wherein the first support head has a plurality of timber layers, wherein in the plurality of timber layers, a first timber layer with the first main fiber direction alternates with a second timber layer with the second main fiber direction, wherein the first support head has at least one first area with a plurality of timber layers of a first timber specie, at least one second area with a plurality of timber layers with a second timber species and at least a third area with a plurality of timber layers in which the first wood species and the second wood species alternate.

14. Storey ceiling construction according to claim 13, wherein a recess for supporting the first upper wooden support directly on the first lower wooden support is placed in the second area, and the second timber species is more stable than the first timber species.

15. Building having a storey ceiling construction having a first lower wooden support for supporting a storey ceiling, a first upper wooden support for supporting a further storey ceiling and a first support head made of wood for introducing the forces of the storey ceiling into the first lower wooden support, wherein the first support head lies on the first lower wooden support and the first upper wooden support is supported directly on the first lower wooden support, wherein the first lower wooden support and the first upper wooden support has a main fiber direction at a right angle to the storey ceiling, wherein the first support head of wood has a first main fiber direction and a second main fiber direction different from the first main fiber direction, wherein the first main fiber direction and the second main fiber direction are arranged in the plane of the storey ceiling, wherein the first support head has a plurality of timber layers parallel to the plane of the storey ceiling, wherein in the plurality of timber layers, a first timber layer comprising fibers extending at least in the first main fiber direction over the complete first support head alternates with a second timber layer comprising fibers extending at least in the second main fiber direction over the complete first support head, wherein the first timber layer comprises exclusively the first main fiber direction or does not comprise a main fiber direction being perpendicular to the plane of the storey ceiling, wherein the second timber layer comprises exclusively the second main fiber direction or does not comprise a main fiber direction being perpendicular to the plane of the storey ceiling.

* * * * *